US007603978B2

(12) United States Patent
Inagawa et al.

(10) Patent No.: US 7,603,978 B2
(45) Date of Patent: Oct. 20, 2009

(54) TANDEM VALVE TYPE THROTTLE BODY FOR TWO-WHEELED VEHICLE

(75) Inventors: Ryouji Inagawa, Kawasaki (JP); Yoji Kojima, Kawasaki (JP)

(73) Assignee: Keihin Corporation, Tokyo (JP)

( * ) Notice: Subject to any disclaimer, the term of this patent is extended or adjusted under 35 U.S.C. 154(b) by 120 days.

(21) Appl. No.: 12/007,502

(22) Filed: Jan. 11, 2008

(65) Prior Publication Data

US 2008/0211117 A1 Sep. 4, 2008

(30) Foreign Application Priority Data

Feb. 16, 2007 (JP) ..... 2007-035679

(51) Int. Cl.
*F02D 9/08* (2006.01)
*F02D 1/00* (2006.01)

(52) U.S. Cl. ..... 123/337; 123/336; 123/400

(58) Field of Classification Search ..... 123/336, 123/337, 399, 400, 442; 251/305
See application file for complete search history.

(56) References Cited

U.S. PATENT DOCUMENTS 4,344,396 A * 8/1982 Yamada ..... 123/337
4,982,710 A * 1/1991 Ohta et al. ..... 123/399
5,150,761 A * 9/1992 Shimanaka et al. ..... 180/197
6,530,362 B1 * 3/2003 Yanagii ..... 123/442
6,751,949 B2 * 6/2004 Tamura et al. ..... 60/284
7,261,082 B2 * 8/2007 Kondo ..... 123/337
2002/0050268 A1 * 5/2002 Deguchi ..... 123/336

FOREIGN PATENT DOCUMENTS

JP 2005-090471 4/2005

* cited by examiner

*Primary Examiner*—John T Kwon
(74) *Attorney, Agent, or Firm*—Bacon & Thomas, PLLC

(57) ABSTRACT

To stably maintain an opening degree characteristic of a driven lever, the driven lever (5) is attached to one end (3A) of a main throttle shaft (3) to which a main throttle valve (4) is attached, a cam lever (10) is attached to one end (8A) of a sub throttle shaft (8) to which a sub throttle valve (9) is attached, a cam surface (10A) of the cam lever (10) faces to a roller (5A) of the driven lever (5), a cup-shaped throttle cover (12) is arranged on one side wall (1A) of a throttle body (1), an opening portion (12C) of a throttle cover (12) is closed by a closing cover (20), and a lever storage chamber (22) formed by the throttle cover (12) and the closing cover (20) accommodates the cam lever (10) and the driven lever (5).

4 Claims, 4 Drawing Sheets

TANDEM VALVE TYPE THROTTLE BODY FOR TWO-WHEELED VEHICLE

BACKGROUND OF THE INVENTION

1. Field of the Invention

The present invention relates to an intake control apparatus controlling an amount of air flowing toward an engine, and more particularly to a tandem valve type throttle body for a two-wheeled vehicle provided with a main throttle valve for opening and closing an intake passage provided through in an inner portion of a throttle body in accordance with an accelerator grip operation by a driver, and a sub throttle valve driven and operated by an electric motor driven in correspondence to an operating state of the engine for opening and closing the intake passage at an upstream side from the main throttle valve, within the intake passage.

2. Description of the Conventional Art

Japanese Unexamined Patent Publication No. 2005-90471 discloses a conventional tandem valve type throttle body for a two-wheeled vehicle having a main throttle valve operated by a driver and a sub throttle valve operated by an electric motor which are arranged within an intake passage provided within a throttle body, opening the sub throttle valve by driving the electric motor at a time when the main throttle valve is fully closed, and forcibly opening the main throttle valve toward a first idling opening degree on the basis of an opening motion of the sub throttle valve independently from an operation of an accelerator grip.

According to the structure in the Japanese Unexamined Patent Publication No. 2005-90471 mentioned above, the main throttle valve attached to a main throttle shaft is arranged in an intake passage provided so as to pass through the throttle body, a throttle drum is attached to one end of the main throttle shaft, and the throttle drum is connected to an accelerator grip operated by a driver with a valve opening wire and a valve closing wire.

Further, the sub throttle valve attached to a sub throttle shaft is arranged in the intake passage at an upstream side from the main throttle valve, and the sub throttle valve is operated by an electric motor driven in correspondence to an operating state of the engine.

In other words, the throttle drum is rotated forward and backward via the valve opening wire and the valve closing wire on the basis of the operation of the accelerator grip by the driver, whereby the main throttle valve opens and closes the intake passage. Further, the sub throttle shaft is rotated forward and backward by the electric motor, whereby the sub throttle valve opens and closes the intake passage.

On the other hand, a cam lever having a cam surface is attached to one end of the sub throttle shaft, a driven lever having a roller is attached to one end of the main throttle shaft, and the roller is arranged so as to face to the cam surface of the cam lever. In accordance with the structure mentioned above, the main throttle valve mechanically controls so as to open and close the intake passage by an accelerator grip operated by the driver, and the sub throttle valve electrically controls so as to open and close the intake passage by the electric motor driven in correspondence to the operating state of the engine. Further, when the sub throttle valve is fully opened by the electric motor, the cam surface of the cam lever rotates the driven lever via the roller, whereby the main throttle valve opens the intake passage at a fixed opening degree toward the first idling opening degree independently from the operation of the accelerator grip.

SUMMARY OF THE INVENTION

Problem to be Solved by the Invention

In accordance with the conventional tandem valve type throttle body mentioned above, the cam surface of the cam lever and the roller of the driven lever, that is, a contact portion of the cam lever and the driven lever are mounted to a two-wheeled vehicle in the state of being directly exposed to an atmospheric air.

In accordance with the structure mentioned above, there is a risk that a foreign matter is bitten into the contact portion between the cam lever and the driven lever at a time of traveling on a bad road, traveling on a wetland, traveling on a sandy land or the like by the two-wheeled vehicle, it is necessary to increase a frequency of maintenance of the contact portion mentioned above (increase a maintaining frequency), and a lot of working time is necessary.

Further, there is a risk that an abrasion is generated at the contact portion due to a small foreign matter attached to the contact portion during a long time use, and a lot of developing man hour is necessary for selection of a material and a surface treatment of the lever, the roller and the like, in order to maintain a stable opening degree characteristic over a long period.

Further, there is a risk that an external force is directly applied to the driven lever including the throttle drum, and the cam lever, at a time when the vehicle falls down, and it is necessary to form those parts with greatly increased rigidity.

Further, since the throttle lever, the driven lever and the cam lever are directly exposed to the side portion of the two-wheeled vehicle, an outer appearance of the two-wheeled vehicle is deteriorated, and there is a risk that the lever or the like catches on a leg portion of a driver. Thus freedom of layout design is obstructed.

The present invention is made by taking the problems mentioned above into consideration, and a main object of the present invention is to provide a tandem valve type throttle body for a two-wheeled vehicle with the structure that a cam lever is attached to one end of a sub throttle shaft to which a sub throttle valve is attached, a driven lever is attached to one end of a main throttle shaft to which a main throttle valve is attached, the driven lever is operated so as to be opened by the cam lever at a time of fully opening of the sub throttle valve, and the main throttle valve is opened toward a first idling opening degree, wherein the tandem valve type throttle body can stably maintain an opening degree characteristic of the driven lever by the cam lever over a long period, has a low maintenance frequency and is preferably mounted particularly to the two-wheeled vehicle.

Means for Solving the Problem

In order to achieve the object mentioned above, in accordance with a first aspect of the present invention, there is provided a tandem valve type throttle body for a two-wheeled vehicle with the structure that an intake passage is provided through in an inner portion of the throttle body, a main throttle valve and a sub throttle valve are provided within the intake passage, the main throttle valve opens and closes the intake passage in accordance with an accelerator grip operation by a driver, the sub throttle valve is arranged in the intake passage at an upstream side from the main throttle valve and operated by an electric motor driven in correspondence to an operating state of an engine so as to open and close the intake passage, a cam lever is attached to one end of a sub throttle shaft to which the sub throttle valve is attached, the cam lever is arranged so as to be brought into contact with a driven lever attached to one end of a main shaft to which the main throttle valve is attached, and the main throttle valve is opened at a fixed opening degree in correspondence to an opening degree of the sub throttle valve, wherein a throttle cover is integrally formed at one side wall of the throttle body so as to surround the driven lever and the cam lever and be open toward one side direction with an opening portion, and wherein a lever storage chamber is formed by closing the opening portion of the throttle cover with a closing cover, and the driven lever and the cam lever are arranged so as to be stored within the lever storage chamber.

Further, in accordance with a second aspect of the present invention, in addition to the first aspect mentioned above, a first outer cable end bolt insertion hole and a second outer cable end bolt insertion hole, where a first outer cable end bolt and a second outer cable end bolt for penetration of a valve opening wire and a valve closing wire for connecting a throttle drum attached to one end of the main throttle shaft with the accelerator grip are inserted are formed in the throttle cover, the first outer cable end bolt is arranged so as to be screwed into the first outer cable end bolt insertion hole, and the second outer cable end bolt is arranged so as to be screwed into the second outer cable end bolt insertion hole.

Further, in accordance with a third aspect of the present invention, in addition to the first aspect mentioned above, a bypass air passage is provided so as to bypass the main throttle valve arranged in the intake passage, an air control valve for controlling the opening of the bypass air passage is provided, and a regulating portion of the air control valve is arranged in an opening manner so as to face to an inner side of the lever storage chamber.

Further, in accordance with a fourth aspect of the present invention, in addition to the third aspect mentioned above, the throttle cover is formed in a cup shape independently from the throttle body, a bottom portion of the throttle cover is arranged so as to be brought into contact with one side wall of the throttle body, a part of a side wall of the throttle cover is positioned so as to be brought into contact with an outer periphery of an air control valve insertion tube portion in which the air control valve is arranged by screwing, and the throttle cover is arranged so as to be screwed to the throttle body in the state of being so positioned and contacted.

EFFECT OF THE INVENTION

In accordance with the first aspect of the present invention, the lever storage chamber is formed at the one side wall of the throttle body by the throttle cover, and the closing cover for closing the opening portion of the throttle cover, and the driven lever and the cam lever are arranged so as to be stored within the lever storage chamber.

In accordance with the structure mentioned above, since the foreign matter such as water, mud or the like does neither enter nor attach to the contact portion between the driven lever and the cam lever from the outer portion, it is possible to obtain a first idling opening degree of the main throttle valve in accordance with the stable full open of the sub throttle valve over a long time period. Further, since an affect by the foreign matter can be excluded, it is possible to very easily select the material and the surface treatment of the driven lever and the cam lever (particularly, the contact portion between the levers).

Further, since the driven lever and the cam lever are protected by the lever storage chamber even at a time when the two-wheeled vehicle falls down or the like, these levers are securely protected without increasing the rigidity largely.

Further, since the driven lever and the cam lever are not directly exposed to the atmospheric air, the closing cover is arranged toward the outer side, and the levers are arranged in the inner portion thereof, it is possible to suppress interference with a leg portion of a driver as well as it is possible to improve an outer appearance of the two-wheeled vehicle.

Further, in accordance with the second aspect of the present invention, the first and second outer cable end insertion holes are formed with the throttle cover and the closing cover, and the first and second outer end bolts are arranged so as to be screwed into the first and second outer cable end insertion holes. Accordingly, it is not necessary to particularly prepare the conventionally used wire stay.

Further, in accordance with the third aspect of the present invention, since the idling air amount is decided by the air amount controlled in accordance with the opening degree of the main throttle valve, and the air amount within the bypass air passage controlled in accordance with the opening degree of the air control valve, and the regulating portion of the air control valve is arranged within the lever storage chamber at this time, the air control valve is not accidentally operated, and it is possible to provide a proper idling air amount which is set at an early stage.

Further, water, mud or the like does not enter toward the air control valve from the outer portion, it is possible to simultaneously achieve a dust proofing countermeasure with respect to the air control valve.

Further, in accordance with the fourth aspect of the present invention, the throttle cover is formed as the independent element in a cup shape, and the bottom portion of the throttle cover is screwed to the one side wall of the throttle body.

Accordingly, the one side wall of the throttle body can be formed by casting toward the side portion regardless of the shape of the throttle cover, it is possible to form by casting the one side wall shape of the throttle body in a simple shape, and it is particularly possible to improve an injection molding characteristic of the throttle body without providing a wasteful thickness.

Further, since a part of the side wall of the throttle cover is brought into contact with the outer periphery of the air control valve insertion tube portion so as to be screwed, at a time of screwing the throttle cover to the one side wall of the throttle body, it is possible to more securely and firmly position and fix the throttle cover to the throttle body even at a time when a pressing force is applied toward the throttle cover from the first and second outer cable end bolts in the case of operating the accelerator grip.

DETAILED DESCRIPTION OF PREFERRED EMBODIMENT

A description will be given below of an embodiment of a tandem valve type throttle body for a two-wheeled vehicle in accordance with the present invention with reference to the accompanying drawings.

Figure 1:
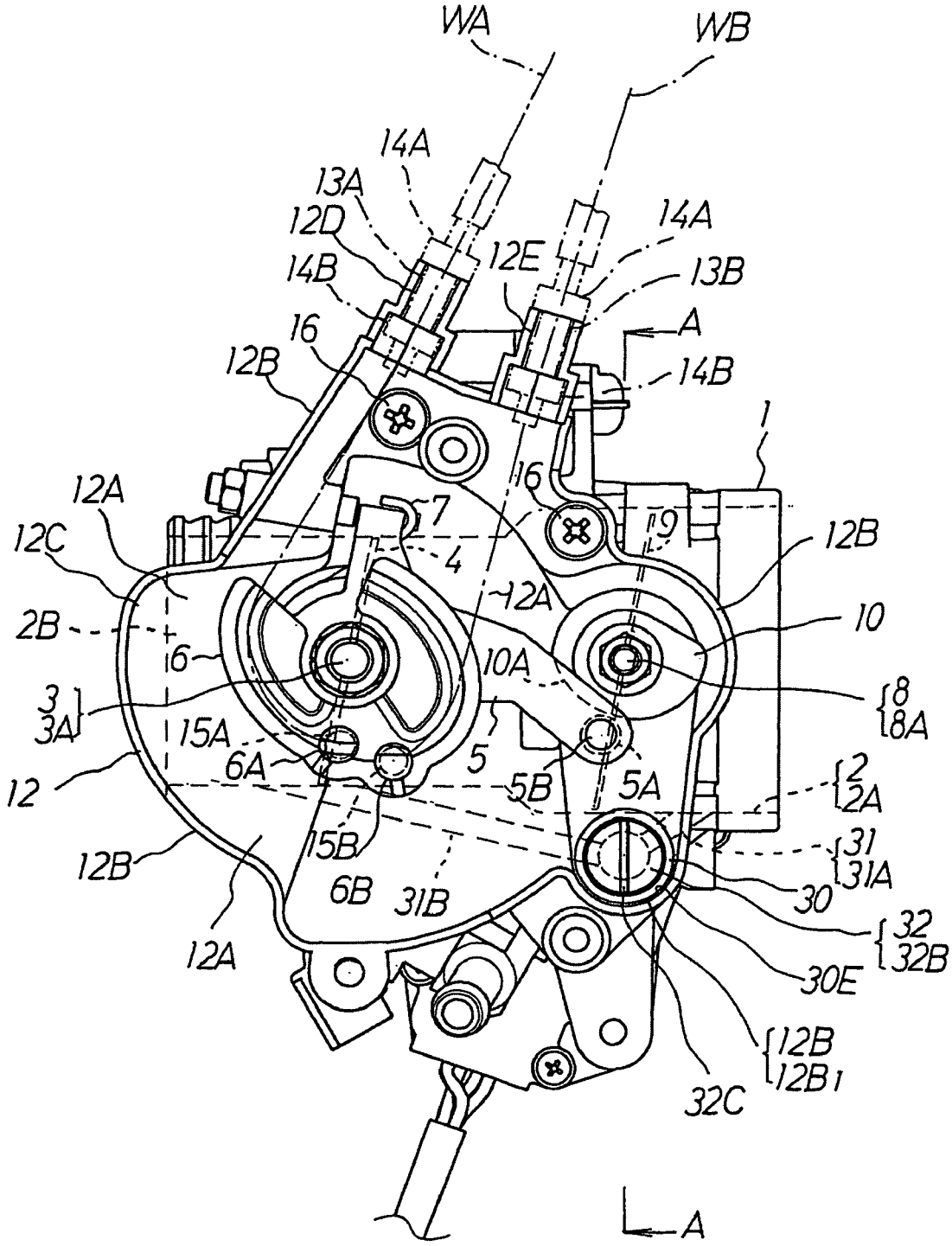
FIG. 1 is a side view in a state that a closing cover is detached, showing an embodiment of a tandem valve type throttle body for a two-wheeled vehicle in accordance with the present invention.
Figure 2:
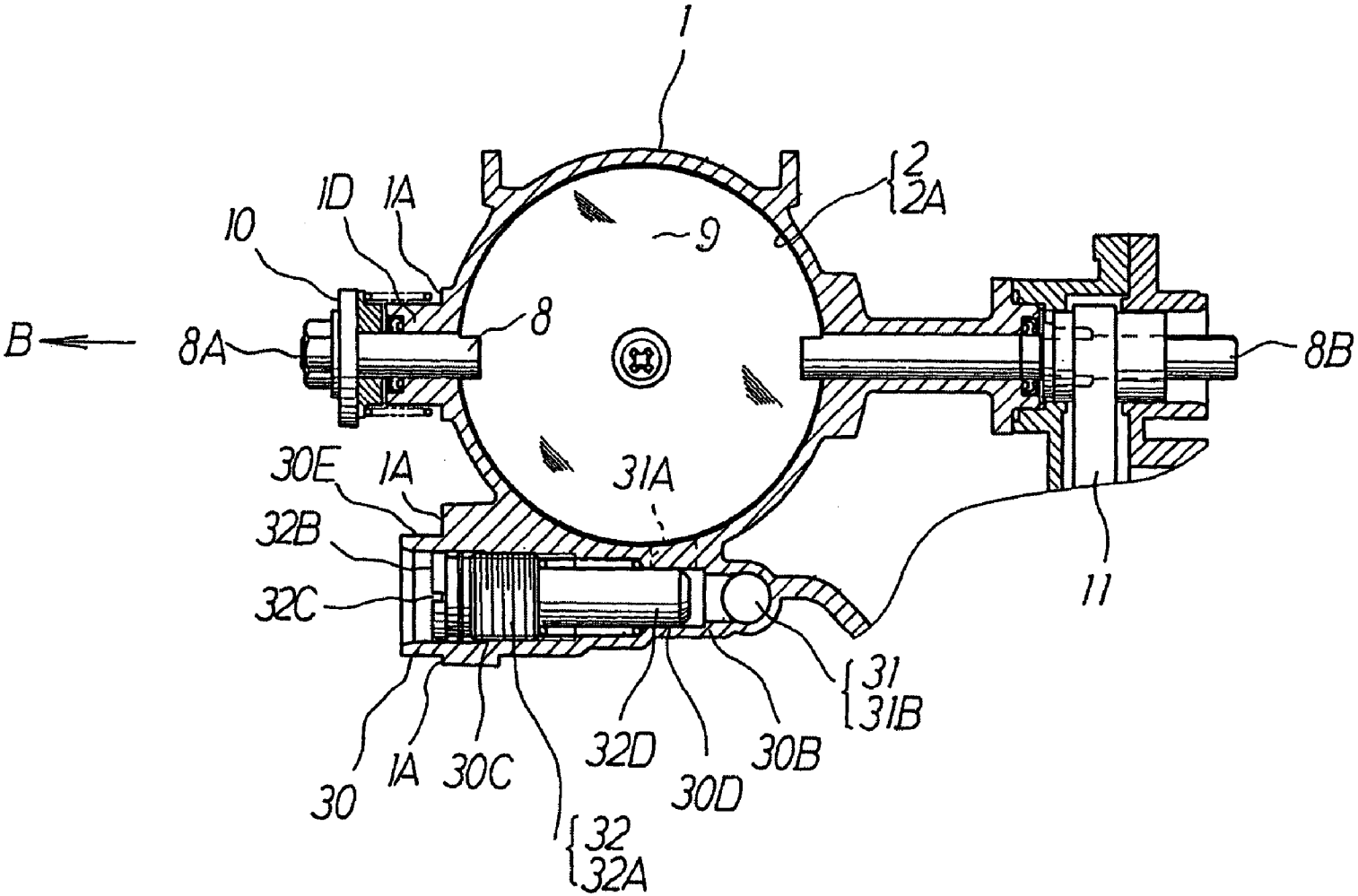
FIG. 2 is a vertical sectional view of a main portion along a line A-A in FIG. 1.
Figure 3:
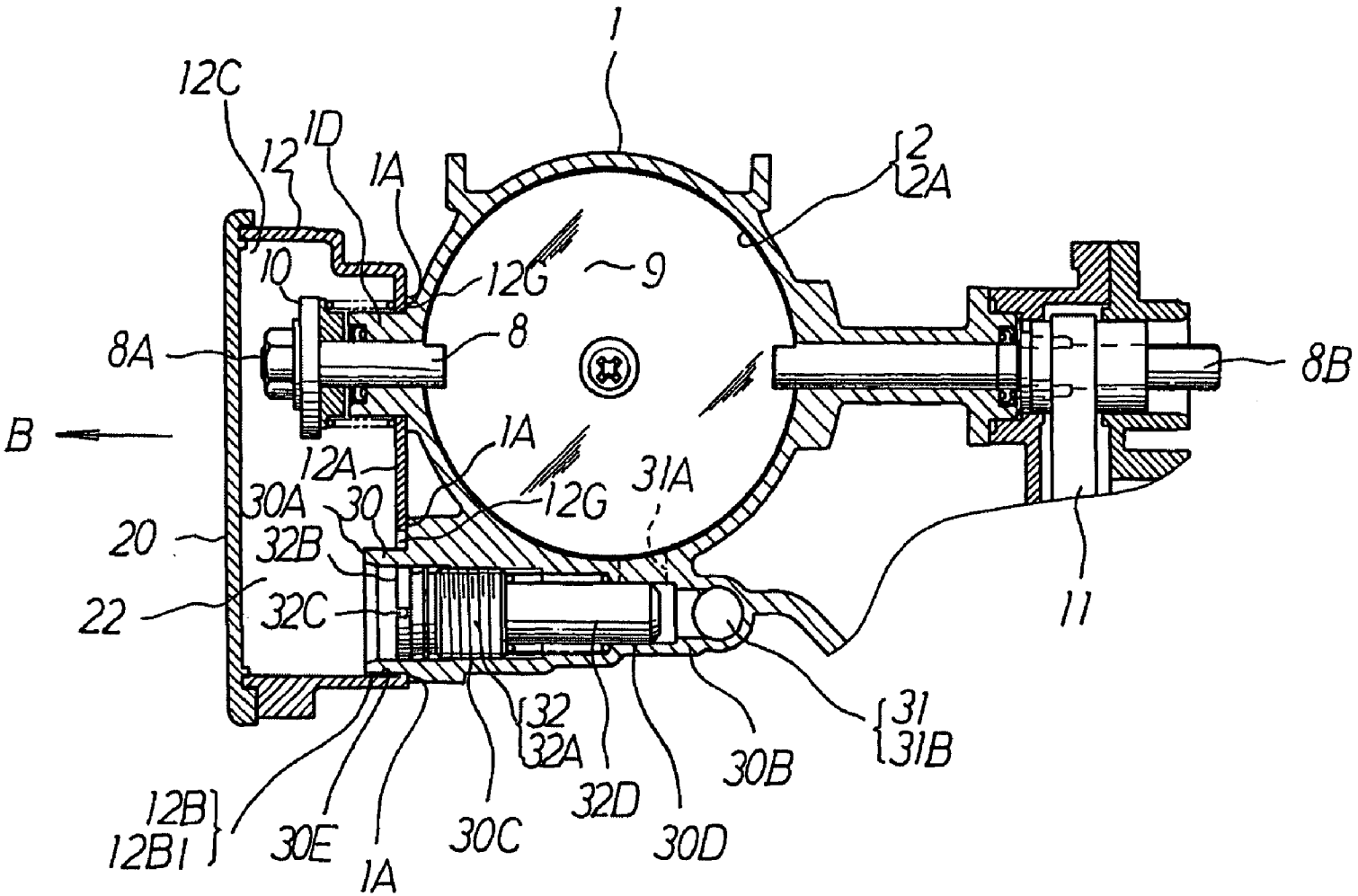
FIG. 3 is a vertical sectional view of a main portion in a state that the closing cover is arranged in FIG. 2.
Figure 4:
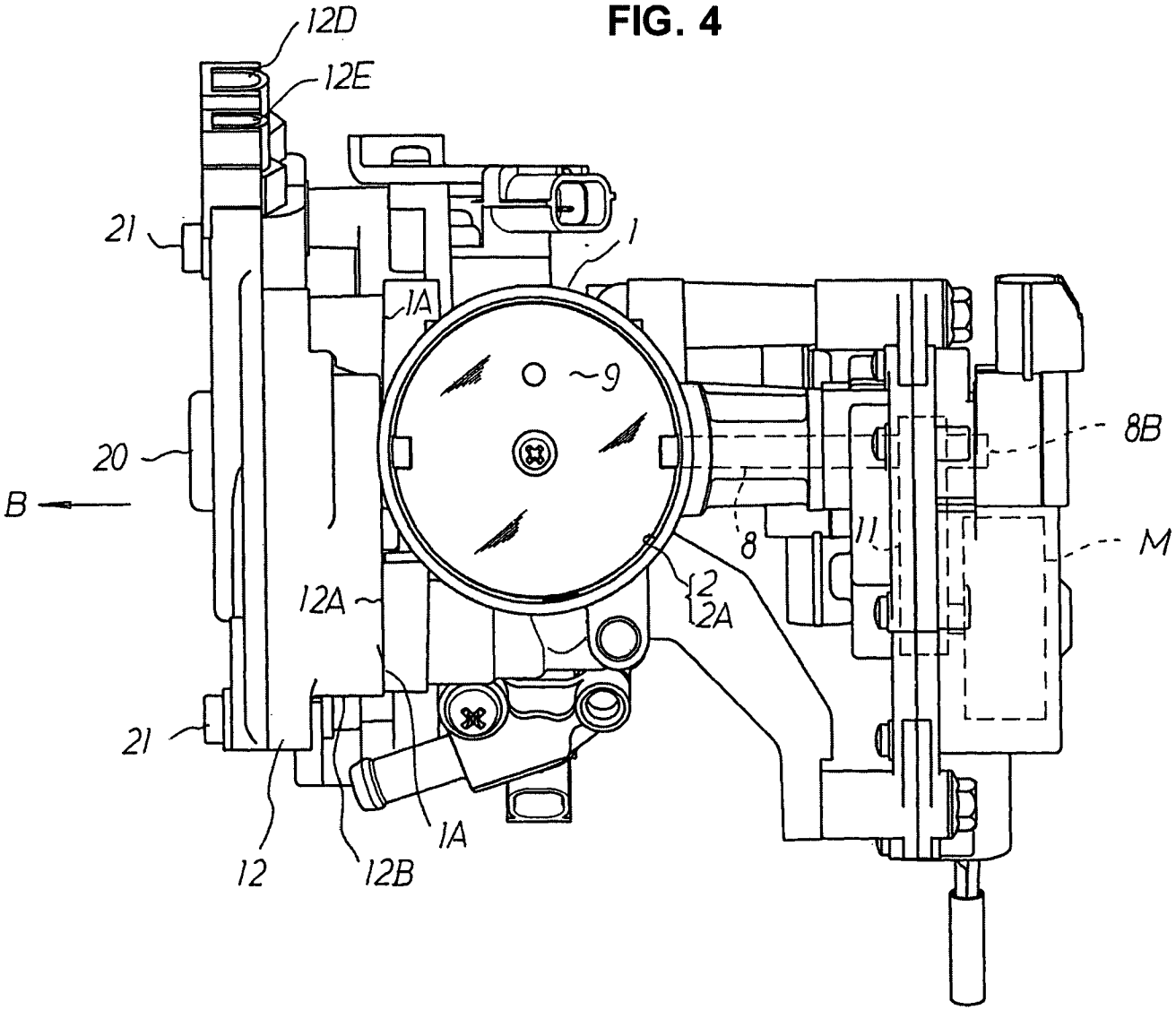
FIG. 4 is a right side view in a state that the closing cover is arranged in FIG. 1.

FIG. 1 is a side view. FIG. 2 is a vertical sectional view of a main portion along a line A-A in FIG. 1. FIG. 3 is a vertical sectional view of a main portion in a state that the closing cover is arranged in FIG. 2. FIG. 4 is a right side view in the state that the closing cover is arranged in FIG. 1.

Reference numeral 1 denotes a throttle body provided such that an intake passage 2 passes through an inner portion.

Reference numeral 3 denotes a main throttle shaft rotatably borne to the throttle body 1 to extend across the intake passage 2. A main throttle valve 4 arranged within the intake passage 2 is attached to the main throttle shaft 3 so as to open and close the intake passage 4.

In accordance with the structure mentioned above, the intake passage is separated into an upstream side intake passage 2A and a downstream side intake passage 2B by the main throttle valve 4, the upstream side intake passage 2A is connected to an air cleaner (not shown), and the downstream side intake passage 2B is connected to an engine (not shown).

Further, a driven lever 5 and a throttle drum 6 are arranged so as to be screwed to one end 3A (a left side in FIG. 2) of the main throttle shaft 3 by a nut, and the driven lever, the throttle drum 6, the main throttle shaft 3 and the main throttle valve 4 are integrally rotated. The main throttle valve 4 opens the intake passage 2 by rotating in a clockwise direction in FIG. 1, and closes the intake passage 2 by rotating in a counterclockwise direction. Further, a roller 5A is arranged at a leading end portion of the driven lever 5 so as to be rotatably supported to a shaft 5B. In accordance with the structure mentioned above, the driven lever 5 including the roller 5A, and the throttle drum 6 are arranged so as to further protrude to one side B from one side wall 1A of the throttle body 1.

In this case, reference symbol 6A denotes a valve opening cable end hole provided in the throttle drum 6, reference symbol 6B denotes a valve closing cable end hole, and reference numeral 7 denotes a throttle valve return spring for applying a rotating force in a closing direction to the main throttle valve 4.

Reference numeral 8 denotes a sub throttle shaft rotatably borne to the throttle body 1 to extend across the intake passage 2A at the upstream side of the main throttle valve 4, and a sub throttle valve 9 opening and closing the upstream side intake passage 2A is attached to the sub throttle shaft 8.

A cam lever 10 provided with a cam surface 10A is arranged at one end 8A of the sub throttle shaft 8 so as to be screwed by a nut. In accordance with the structure mentioned above, the cam lever 10 is arranged so as to further protrude to one side B from the one side wall 1A of the throttle body 1, and a cam surface 10A of the cam lever 10 is arranged so as to face to the roller 5A of the driven lever 5. In this case, the sub throttle valve 9 opens the upstream side intake passage 2A by rotating in a clockwise direction in FIG. 1.

In summary, the throttle drum 6 screwed to the one end 3A of the main throttle shaft 3, the driven lever 5 including the roller 5A, and the cam lever 10 provided with the cam surface 10A screwed to the one end 8A of the sub throttle shaft 8 are arranged so as to protrude toward the one side portion B from the one side wall 1A of the throttle body 1.

In this case, the other end 8B of the sub throttle shaft 8 is coupled to an electric motor M driven in correspondence to an operating state of the engine via a reduction gear 11, and the sub throttle shaft 8, the sub throttle valve 9 and the cam lever 10 are rotationally controlled by the electric motor M. The reduction gear 11 and the electric motor M are shown in FIG. 4 in an abbreviated manner.

The above is the conventionally known structure, and the following structure is added in the present invention.

Reference numeral 12 denotes a cup-shaped throttle cover. The throttle cover 12 has a bottom portion 12A at a right side in FIG. 3, is provided with a side wall 12B extending from the bottom portion 12A toward a left side, and is formed so as to be open to a left side with an opening portion 12C at a left side end of the side wall 12B.

Further, the side wall 12B of the throttle cover is formed in a tubular shape surrounding each of outer peripheral portions of the throttle drum 6, the driven lever 5 including the roller 5A, and the cam lever 10 including the cam surface 10A. The throttle drum, the driven lever 5 and the cam lever 10 are arranged in an inner side of the side wall 12B of the throttle cover 12, and rotations thereof are not obstructed by the side wall 12B.

Further, the side wall 12B of the throttle cover 12 is formed with a first outer cable end bolt insertion hole 12D open to the opening portion 12C with a semicircular hole, and a second outer cable end bolt insertion hole 12E.

The first and second outer cable end bolt insertion holes 12D and 12E can be understood by FIGS. 1 and 4.

Further, the bottom portion 12A of the throttle cover is arranged on the one side wall 1A of the throttle body 1, the bottom portion 12A of the throttle cover 12 is arranged so as to be screwed toward the one side wall 1A of the throttle body 1 by a screw 16 in the state mentioned above. Accordingly, the throttle cover 12 is fixedly arranged on the one side wall 1A of the throttle body 1.

In accordance with the structure mentioned above, the throttle drum 6, the driven lever 5 and the cam lever 10 are arranged in an inner side of the side wall 12B of the throttle cover 12. In this case, at a time of arranging the bottom portion 12A of the throttle cover on the one side wall 1A of the throttle body 1, a clearance hole 12G (shown in FIG. 3) is provided in correspondence to a bearing tube portion 1D (shown in FIG. 3) supporting the sub throttle shaft 8, a bearing tube portion supporting the main throttle shaft 3 (not shown) and the like. Further, the throttle drum 6, the driven lever 5 and the cam lever 10 are screwed to one end of the main throttle shaft 3 and the sub throttle shaft 8 after the throttle cover 12 is arranged on the one side wall 1A of the throttle body 1.

In this case, a valve opening wire WA and a valve closing wire WB, the other ends of which are respectively locked to an accelerator grip (not shown), are connected to the throttle drum 6 in accordance with the following manner.

Reference symbol 13A denotes a first outer cable end bolt in which a male thread is formed on an outer periphery, an insertion hole is provided through in an inner side thereof, and the valve opening wire WA is arranged so as to be inserted into the insertion hole. The first outer cable end bolt 13A is arranged so as to be inserted into a first outer cable end bolt insertion hole 12D of the throttle cover 12, and nuts 14A and 14B are next screwed to both ends of the male thread of the first outer cable end bolt 13A so as to be held and fixed to the throttle cover 12. Further, in the state mentioned above, a drum-shaped end 15A arranged at one end of the valve opening wire WA is locked within the valve opening cable end hole 6A of the throttle drum 6.

Reference symbol 13B denotes a second outer cable end bolt in which a male thread is formed on an outer periphery, an insertion hole is provided through in an inner side thereof, and the valve closing wire WB is arranged so as to be inserted into the insertion hole. The second outer cable end bolt 13B is arranged so as to be inserted into a second outer cable end bolt insertion hole 12E of the throttle cover 12, and the nuts 14A and 14B are next screwed to both ends of the male thread of the second outer cable end bolt 13B so as to be held and fixed to the throttle cover 12. Further, in the state mentioned above, a drum-shaped end 15B arranged at one end of the valve closing wire WB is locked within the valve closing cable end hole 6B of the throttle drum 6. Further, the valve opening wire WA and the valve closing wire WB are adjusted by moving the first and second outer cable end bolts 13A and 13B in a wire direction. In this case, the first and second outer cable end bolts 13A and 13B are shown by a single-dot chain line in FIG. 1.

Reference numeral 20 denotes a closing cover arranged on the opening portion 12C of the throttle cover 12, and closing the opening portion 12C. The closing cover 20 is arranged so as to be screwed toward the throttle cover 12 by a screw 21 (the screw 21 is shown in FIG. 4).

In accordance with the structure mentioned above, there is formed a lever storage chamber 22 in which the opening portion 12C of the throttle cover 12 is closed by the closing cover 20 so as to be formed in a sealed state, and the throttle drum, the driven lever 5 including the roller 5A, the cam lever 10 including the cam surface 10A, and the throttle valve return spring 7 are arranged so as to be stored within the lever storage chamber 22. Further, openings of the first outer cable end bolt insertion hole 12D in which the first outer cable end bolt 13A is arranged so as to be inserted, and the second outer cable end bolt insertion hole 12E in which the second outer cable end bolt 13B is arranged so as to be inserted are closed by the closing cover 20 in a state that the first outer cable end bolt 13A and the second outer cable end bolt 13B are inserted and fixed.

In accordance with the tandem valve type throttle body for the two-wheeled vehicle on the basis of the present invention constituted by the structure mentioned above, when the driver operates the accelerator grip (not shown) to the opening side, the valve opening wire WA rotates the throttle drum 6 in the clockwise direction in FIG. 1, and the main throttle valve 4 mechanically controls so as to open the intake passage 2 in correspondence to the opening motion of the accelerator grip. On the other hand, when the driver operates the accelerator grip to the closing side, the valve closing wire WB rotates the throttle drum 6 in the counterclockwise direction, and the main throttle valve 4 mechanically controls so as to close the intake passage 2 in correspondence to the closing motion of the accelerator grip. A description will be given of a cold starting time in the state that an ambient atmospheric temperature of the engine is low. When a main switch of the engine is turned on for starting the engine, an ECU (not shown) outputs a drive signal to the electric motor M on the basis of an information such as an intake air temperature, a cooling water temperature, a lubricating oil temperature or the like input thereto. The electric motor M is driven in correspondence to the drive signal, and rotates the sub throttle shaft 8 largely to an open side (the clockwise direction in FIG. 1). In accordance with the rotation in the clockwise direction (the opening side) of the sub throttle shaft 8 and the sub throttle valve 9, the cam lever 10 is synchronously rotated largely in the clockwise direction. Accordingly, the cam surface 10A of the cam lever 10 is brought into contact with the roller 5A, and rotates the driven lever 5 in the clockwise direction.

Further, in accordance with the rotation in the clockwise direction of the driven lever 5, the main throttle valve 4 is automatically opened to a fixed opening degree from the idling opening degree independently from the operation of the accelerator grip by the driver so as to obtain the first idling opening degree, whereby it is possible to carry out an improved cold start of the engine.

In this case, in accordance with the present invention, the roller 5A provided on the driven lever 5, and the cam lever 10 provided with the cam surface 10A arranged so as to face to the roller 5A are stored within the lever storage chamber 22 formed approximately in a sealed state by the throttle cover 12 and the closing cover 20.

In accordance with the structure mentioned above, since a foreign matter such as mud, water or the like does neither enter nor attach particularly to the contact portion between the roller 5A and the cam surface 10A, it is possible to stably control the rotation of the driven lever 5 for a long time period on the basis of the rotation of the cam lever 10, whereby it is possible to maintain a stable and accurate first idling opening degree of the main throttle valve 4.

Further, in accordance with the structure mentioned above, since the attachment of the foreign matter and the biting of the foreign matter are not generated at the contact portion between the roller 5A and the cam surface 10A, it is possible to very easily select the material and the surface treatment of the roller 5A and the cam lever 10, it is particularly possible to omit a durability test with respect to the foreign matter, and it is possible to largely reduce a developing man-hour.

Further, within the lever storage chamber 22, there are stored and arranged the throttle drum 6 and the throttle valve return spring 7 in addition to the cam lever and the driven lever 5. Accordingly, the levers are not arranged so as to be directly exposed to the atmospheric air, at a time when the tandem valve type throttle body is mounted to the two-wheeled vehicle.

In accordance with the structure mentioned above, it is possible to improve a side outer appearance of the two-wheeled vehicle. Further, it is possible to suppress the interference between a leg portion of a driver and the levers. Further, since the external force can be prevented from being directly applied to the levers at a time when the two-wheeled vehicle falls down, it is not necessary to largely increase the rigidity of the levers, and the manufacturing cost can be reduced.

Further, since the first outer cable end bolt insertion hole 12D and the second outer cable end bolt insertion hole 12E are formed in the throttle cover 12, and the first outer cable end bolt 13A and the second outer cable end bolt 13B are arranged so as to be screwed to the outer cable end bolt insertion holes 12D and 12E by the nuts 14A and 14B, the wire stay conventionally formed by bending the plate member in accordance with the pressing process is not necessary.

Further, since the opening to the opening portion 12C of the first and second outer cable end bolt insertion holes 12D and 12E is closed by the closing cover 20, and the outer cable end bolts 13A and 13B are arranged within the closed outer cable end bolt insertion holes 12D and 12E, the nuts 14A and 14B do not stick thereto due to corrosion, and it is possible to easily attach and detach.

Reference is made again back to FIG. 2 again. Reference numeral 30 denotes an air control valve insertion tube portion formed so as to protrude toward one side direction B from the one side wall 1A of the throttle body 1. A female thread hole 30C and a control hole 30D are continuously provided from one side end 30A of the air control valve insertion tube portion 30 toward the other side end 30B direction, an upstream side bypass air passage 31A connected to the upstream side intake passage 2A from the main throttle valve 4 is open at a side wall of the control hole 30D, and a downstream side bypass air passage 31B connected to the downstream side intake passage 2B from the main throttle valve 4 is open at a bottom portion of the control hole 30D. The upstream side and downstream side bypass air passages 31A and 31B correspond to a bypass air passage 31 bypassing the main throttle valve 4.

Reference numeral 32 denotes an air control valve for regulating and controlling an amount of bypass air flowing through the bypass air passage 31. The air control valve 32 is constituted by the following elements. Reference symbol 32A denotes a male thread screwed to the female thread hole 30C. A regulating portion 32C is formed at one side end 32B connected to the male thread 32A. In the present embodiment, the regulating portion 32C is formed as a minus shaped groove.

Further, the other side end connected to the male thread 32A is continuously provided with a control valve portion 32D inserted into the control hole 30D to control an opening area of the upstream side bypass air passage 31A open to a side wall of the control hole 30D.

In this case, while the cup-shaped throttle cover 12 constituted by the bottom portion 12A and the side wall 12B is arranged so as to be brought into contact with the one side wall 1A of the throttle body 1, the throttle cover 12 is arranged so as to be screwed to the throttle body 1 by the screw 16, and the opening portion 12C of the throttle cover 12 is next closed by the closing cover 20, particularly the regulating portion 32C of the air control valve 32 is also arranged so as to face to the inner side of the lever storage chamber 22, in addition to the driven lever and the cam lever 10.

Further, a description will be given of the regulation of the bypass air passage 31 by the air control valve 32. In the state that the opening portion 12C of the throttle cover 12 is not closed by the closing cover 20, the air control valve 32 is rotated forward and backward via the regulating portion 32C, and it is possible to control the bypass air amount in a reducing direction by reducing the opening area of the upstream side bypass air passage 31A open to the inner side of the control hole 30D in such direction that the control valve portion 32D of the air control valve 32 moves forward into the control hole 30D.

On the other hand, it is possible to control the bypass air amount in an increasing direction by increasing the opening area of the upstream side bypass air passage 31A open to the inner side of the control hole 30D, in such direction that the control valve portion 32D moves backward from the inner side of the control hole 30D.

Further, it is possible to regulate a proper bypass air amount on the basis of the rotation of the air control valve 32, and the opening portion 12C of the throttle cover 12 is closed by the closing cover 20 after the regulation of the air control valve 32.

As mentioned above, in accordance with the structure in which the regulating portion 32C of the air control valve 32 is arranged within the closed lever storage chamber 22, since the air control valve 32 is not unnecessarily rotated after the regulation of the air control valve 32, it is possible to provide an initially set proper bypass air amount, and it is possible to carry out an improved idling operation. Further, since water, mud or the like do not enter into portions between the male thread 32A of the air control valve 32 and the female thread hole, and between the control valve portion 32D and the control hole 30D, it is possible to completely achieve a dust proofing countermeasure with respect to the air control valve 32 without using an airtight member such as a seal ring or the like. In this case, when the regulation of the bypass air amount is necessary, the regulation can be carried out by detaching the closing cover 20 again.

Further, at a time of arranging the throttle cover on the one side wall 1A of the throttle body 1 so as to be screwed via the screw 16, it is possible to more firmly fix the throttle cover 12 to the throttle body 1 by positioning and arranging a part 12B1 of the side wall 12B of the throttle cover 12 so as to be brought into contact with the outer periphery 30E of the air control valve insertion tube portion 30.

Particularly, in the structure in which the first and second outer cable end bolts 13A and 13B are screwed to the throttle cover 12, such as the present embodiment, the rotating force is always applied to the throttle cover 12 on the basis of a traction operation of the valve opening and closing wires WA and WB, however, it is possible to inhibit the rotation of the throttle cover 12 without increasing the screw or the like, on the basis of the positioning between the part 12B1 of the side wall 12B of the throttle cover 12 and the outer periphery 30E of the air control valve insertion tube portion 30.

In this case, the tandem valve type throttle body in accordance with the present invention can be employed in a buggy vehicle used for traveling on a bad road, and an outboard engine traveling on the water, in addition to the two-wheeled vehicle.

Further, the throttle cover 12 can be integrally cast with the throttle body 1.

What is claimed is:

1. A tandem valve type throttle body for a two-wheeled vehicle with the structure that an intake passage is provided through in an inner portion of the throttle body, a main throttle valve and a sub throttle valve are provided within said intake passage, the main throttle valve opens and closes the intake passage in accordance with an accelerator grip operation by a driver, the sub throttle valve is arranged in the intake passage at an upstream side from said main throttle valve and operated by an electric motor driven in correspondence to an operating state of an engine so as to open and close the intake passage, a cam lever is attached to one end of a sub throttle shaft to which said sub throttle valve is attached, said cam lever is arranged so as to be brought into contact with a driven lever attached to one end of a main shaft to which the main throttle valve is attached, and the main throttle valve is opened at a fixed opening degree in correspondence to an opening degree of the sub throttle valve, wherein a throttle cover is integrally formed at one side wall of the throttle body so as to surround the driven lever and the cam lever and be open toward one side direction with an opening portion, and wherein a lever storage chamber is formed by closing the opening portion of said throttle cover with a closing cover, and said driven lever and the cam lever are arranged so as to be stored within the lever storage chamber.

2. A tandem valve type throttle body for a two-wheeled vehicle as claimed in claim 1, wherein a first outer cable end bolt insertion hole and a second outer cable end bolt insertion hole, where a first outer cable end bolt and a second outer cable end bolt for penetration of a valve opening wire and a valve closing wire for connecting a throttle drum attached to one end of the main throttle shaft with the accelerator grip are inserted, are formed in said throttle cover, the first outer cable end bolt is arranged so as to be screwed into said first outer cable end bolt insertion hole, and the second outer cable end bolt is arranged so as to be screwed into the second outer cable end bolt insertion hole.

3. A tandem valve type throttle body for a two-wheeled vehicle as claimed in claim 1, wherein a bypass air passage is provided so as to bypass the main throttle valve arranged in the intake passage, an air control valve for controlling the opening of the bypass air passage is provided, and a regulating portion of the air control valve is arranged in an opening manner so as to face to an inner side of said lever storage chamber.

4. A tandem valve type throttle body for a two-wheeled vehicle as claimed in claim 3, wherein said throttle cover is formed in a cup shape independently from the throttle body, a bottom portion of the throttle cover is arranged so as to be brought into contact with one side wall of the throttle body, a part of a side wall of the throttle cover is positioned so as to be brought into contact with an outer periphery of an air control valve insertion tube portion in which said air control valve is arranged by screwing, and the throttle cover is arranged so as to be screwed to the throttle body in the state of being so positioned and contacted.

* * * * *